US009904237B2

(12) United States Patent
Abe et al.

(10) Patent No.: US 9,904,237 B2
(45) Date of Patent: Feb. 27, 2018

(54) DEVELOPING CARTRIDGE INCLUDING PROTRUSION PIVOTALLY MOVABLE RELATIVE TO CASING

(71) Applicant: BROTHER KOGYO KABUSHIKI KAISHA, Nagoya-shi, Aichi-ken (JP)

(72) Inventors: Koji Abe, Nagoya (JP); Motoaki Mushika, Hashima (JP); Kazuna Taguchi, Nagoya (JP); Yasuo Fukamachi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/376,141

(22) Filed: Dec. 12, 2016

(65) Prior Publication Data

US 2017/0261915 A1 Sep. 14, 2017

(30) Foreign Application Priority Data

Mar. 9, 2016 (JP) ..... 2016-045892

(51) Int. Cl.
*G03G 15/04* (2006.01)
*G03G 21/16* (2006.01)
*G03G 15/08* (2006.01)

(52) U.S. Cl.
CPC ..... *G03G 21/1647* (2013.01); *G03G 15/0865* (2013.01)

(58) Field of Classification Search
CPC ..... G03G 15/0813; G03G 21/1676; G03G 21/1821; G03G 21/1857
(Continued)

(56) References Cited

U.S. PATENT DOCUMENTS 6,330,410 B1 12/2001 Okabe et al.
8,346,125 B2 * 1/2013 Shiraki et al. ..... G03G 21/1857 399/119

(Continued)

FOREIGN PATENT DOCUMENTS

EP 1 031 891 A1 8/2000
EP 1 696 278 A2 8/2006

(Continued)

OTHER PUBLICATIONS

English translation of International Search Report and Written Opinion from corresponding International Application No. PCT/JP2016/086698, dated Mar. 7, 2017.

(Continued)

*Primary Examiner* — William J Royer
(74) *Attorney, Agent, or Firm* — Merchant & Gould P.C.

(57) ABSTRACT

In a developing cartridge, a developing roller extends in a first direction. A developing roller gear, a coupling, and first and second idle gears are positioned at an outer surface of a casing. An agitator gear has an end face in the first direction facing the outer surface. A first protrusion is positioned between the end face and the outer surface, and at a position outside of addendum circles of the developing roller gear, coupling, and first and second idle gears. The first protrusion is pivotally movable about an axis extending in the first direction between a first position and a second position. A first protruding portion has, at the first position, a first length in a second direction connecting the developing roller and the first protruding portion, and has, at the second position, a second length different from the first length in the second direction.

9 Claims, 8 Drawing Sheets

(58) Field of Classification Search
USPC ..... 399/111, 113
See application file for complete search history.

(56) References Cited

U.S. PATENT DOCUMENTS

| | | | | |
|---|---|---|---|---|
| 9,342,041 | B2 * | 5/2016 | Noda et al. ..... | G03G 21/1676 |
| 2007/0122165 | A1 | 5/2007 | Igarashi et al. | |
| 2008/0205911 | A1 | 8/2008 | Ishikawa et al. | |
| 2011/0158704 | A1 | 6/2011 | Takagi et al. | |
| 2011/0243578 | A1 | 10/2011 | Ukai et al. | |
| 2012/0057899 | A1 | 3/2012 | Asanuma et al. | |
| 2013/0051851 | A1 | 2/2013 | Fukamachi | |
| 2013/0058675 | A1 | 3/2013 | Anan et al. | |
| 2013/0170845 | A1 | 7/2013 | Itabashi | |
| 2015/0003868 | A1 | 1/2015 | Shimizu et al. | |
| 2015/0005134 | A1 | 1/2015 | Shimizu | |
| 2017/0097588 | A1 | 4/2017 | Fukamachi et al. | |

FOREIGN PATENT DOCUMENTS

| | | | |
|---|---|---|---|
| EP | 2 423 760 | A2 | 2/2012 |
| EP | 2 610 684 | A2 | 7/2013 |
| JP | 2009-181027 | A | 8/2009 |
| JP | 2010-009075 | A | 1/2010 |
| JP | 2011-065181 | A | 3/2011 |
| JP | 2011-133763 | A | 7/2011 |
| JP | 2011-215374 | A | 10/2011 |
| JP | 2013-033266 | A | 2/2013 |
| JP | 2013-050493 | A | 3/2013 |
| JP | 2013-054216 | A | 3/2013 |
| JP | 2013-137429 | A | 7/2013 |
| JP | 2015-011231 | A | 1/2015 |
| JP | 2015-129813 | A | 7/2015 |
| JP | 2016-145906 | A | 8/2016 |
| WO | 2016/125209 | A1 | 8/2016 |
| WO | 2017/057489 | A1 | 4/2017 |

OTHER PUBLICATIONS

Related U.S. Appl. No. 15/380,544, filed Dec. 15, 2016.

International Search Report and Written Opinion issued in related international application PCT/JP2015/004440, dated Oct. 13, 2015.

Office Action issued in related U.S. Appl. No. 15/380,544, dated Apr. 28, 2017.

Extended European Search Report issued in related European application No. EP 15 88 1026.7, dated May 18, 2017.

International Search Report and Written Opinion from corresponding International Application No. PCT/JP2016/078673, dated Dec. 27, 2016.

International Search Report and Written Opinion from corresponding International Application No. PCT/JP2016/086698, dated Mar. 7, 2017.

Office Action (Notice of Allowance) issued in related U.S. Appl. No. 15/380,544, dated Aug. 29, 2017.

International Preliminary Examination Report on Patentability issued in related International Patent Application No. PCT/JP2015/004440 dated Aug. 17, 2017.

* cited by examiner

DEVELOPING CARTRIDGE INCLUDING PROTRUSION PIVOTALLY MOVABLE RELATIVE TO CASING

CROSS REFERENCE TO RELATED APPLICATION

This application claims priority from Japanese Patent Application No. 2016-045892 filed on Mar. 9, 2016. The entire content of the priority application is incorporated herein by reference.

TECHNICAL FIELD

The present disclosure relates to a developing cartridge.

BACKGROUND

A developing cartridge attachable to a drum cartridge is known in the art. A conventional drum cartridge including a photosensitive drum and a pivot arm, and a developing cartridge including a developing roller and a cartridge frame having a side surface provided with a rib. During attachment of the developing cartridge to the drum cartridge, the rib is pressed by the pivot arm, so that the developing roller is pressed against the photosensitive drum.

SUMMARY

In such a conventional developing cartridge, a coupling, an idle gear, and an agitator gear are positioned at a side surface of the cartridge frame. Accordingly, mechanical interference may occur between the rib and one of the idle gear and the agitator gear if the rib were arranged at a position closer to the developing roller in comparison with a positional relationship between the rib and the developing roller in the conventional developing cartridge. As a result, rotation of the gear(s) may be restrained if such mechanical interference occurs.

It is therefore an object of the disclosure to provide a developing cartridge permitting rotation of the gears provided at the side surface of the cartridge frame even if a protruding portion such as a rib is designed to be positioned closer to the developing roller.

In order to attain the above and other objects, one aspect provides a developing cartridge that includes a casing; a developing roller; a developing roller gear; a coupling; a first idle gear; a second idle gear; an agitator; an agitator gear; and a first protrusion. The casing has an outer surface and is configured to accommodate therein developing agent. The developing roller extends in a first direction. The developing roller gear is positioned at the outer surface, is mounted to the developing roller and is rotatable along with the developing roller. The coupling is positioned at the outer surface and is rotatable about a first axis extending in the first direction. The coupling includes a coupling gear engaged with the developing roller gear and is rotatable about the first axis. The first idle gear is positioned at the outer surface and is rotatable about a second axis extending in the first direction. The first idle gear is engaged with the coupling gear. The second idle gear is positioned at the outer surface at a position farther from the outer surface than the first idle gear from the outer surface. The second idle gear is rotatable about the second axis along with the first idle gear and the second idle gear has a diameter smaller than a diameter of the first idle gear. The agitator extends in the first direction and is rotatable about a third axis extending in the first direction. The agitator gear is positioned at the outer surface and mounted to the agitator. The agitator gear is engaged with the second idle gear and is rotatable about the third axis along with the agitator. The agitator gear has an end face in the first direction facing the outer surface. The first protrusion is positioned between the end face and the outer surface. The first protrusion is at a position outside of a first addendum circle defined by the developing roller gear, a second addendum circle defined by the coupling gear, a third addendum circle defined by the first idle gear and a fourth addendum circle defined by the second idle gear. The first protrusion is pivotally movable about a fourth axis extending in the first direction between a first position and a second position. The first protrusion has a first length in a second direction connecting the developing roller and the first protrusion in a state where the first protrusion is at the first position. The first protrusion has a second length in the second direction in a state where the first protrusion is at the second position. The second length is different from the first length.

According to another aspect, a developing cartridge includes a casing; a developing roller; a developing roller gear; a coupling; a first idle gear; a second idle gear; an agitator; an agitator gear; and a first protrusion. The casing has an outer surface and is configured to accommodate therein developing agent. The developing roller extends in a first direction. The developing roller gear is positioned at the outer surface, is mounted to the developing roller and is rotatable along with the developing roller. The coupling is positioned at the outer surface and is rotatable about a first axis extending in the first direction. The coupling includes a coupling gear engaged with the developing roller gear and is rotatable about the first axis. The first idle gear is positioned at the outer surface and is rotatable about a second axis extending in the first direction. The first idle gear is engaged with the coupling gear. The second idle gear is positioned at the outer surface at a position farther from the outer surface than the first idle gear from the outer surface. The second idle gear is rotatable about the second axis along with the first idle gear and the second idle gear has a diameter smaller than a diameter of the first idle gear. The agitator extends in the first direction and is rotatable about a third axis extending in the first direction. The agitator gear is positioned at the outer surface and mounted to the agitator. The agitator gear is engaged with the second idle gear and is rotatable about the third axis along with the agitator. The agitator gear has an end face in the first direction facing the outer surface. The first protrusion is positioned between the end face and the outer surface. The first protrusion is at a position outside of a first addendum circle defined by the developing roller gear, a second addendum circle defined by the coupling gear, a third addendum circle defined by the first idle gear and a fourth addendum circle defined by the second idle gear. The first protrusion is pivotally movable about a fourth axis extending in the first direction between a first position and a second position. The first protrusion has a first surface and a second surface. The first surface is configured to receive a pressing force in a first state where the first protrusion is at the first position. The second surface is configured to receive a pressing force in a second state where the first protrusion is at the second position. A first distance between the developing roller and the first surface in the first state is different from a second distance between the developing roller and the second surface in the second state.

BRIEF DESCRIPTION OF THE DRAWINGS

The particular features and advantages of the disclosure will become apparent from the following description taken in connection with the accompanying drawings, in which.

DETAILED DESCRIPTION

1. Developing Cartridge 1

Figure 1:
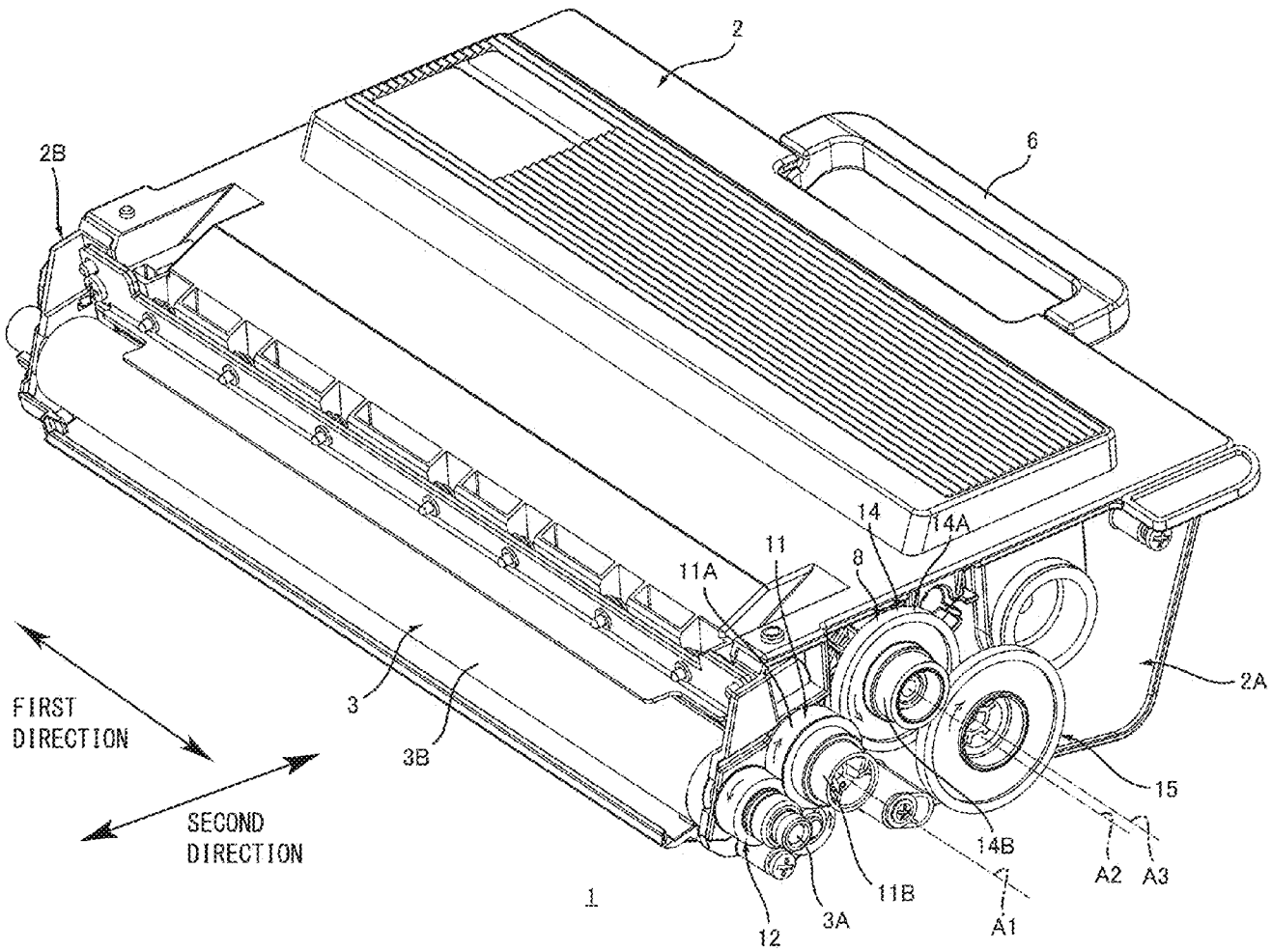
FIG. 1 is a perspective view of a developing cartridge according to one embodiment.

A developing cartridge 1 according to one embodiment will be described with reference to FIGS. 1 through 3.

The developing cartridge 1 is configured to be attached to and detached from an image forming apparatus. The developing cartridge 1 includes a casing 2, a developing roller 3, an agitator 5, a handle 6 and a gear train 8. In the following description, an extending direction of the developing roller 3 will be referred to as a "first direction," as illustrated in FIG. 1.

1.1 Casing

The casing 2 extends in the first direction, and is configured to accommodate therein developing agent such as toner. In the following description, the casing 2 has one side and another side in the first direction, and the side at which the gear train 8 is provided will be referred to as the one side. Further, the term "inside" of the casing 2 implies a side in which the toner is accommodated, and the terms "inner surface" of the casing 2 is the surface defining the inside. The term "outside" of the casing 2 implies a side exposed to an atmosphere, and the terms "outer surface" of the casing 2 implies the surface defining the outside. The casing 2 has one outer surface 2A and another outer surface 2B in the first direction.

1.2 Developing Roller 3

The developing roller 3 is configured to supply developing agent in the casing 2 to a photosensitive drum 31 (FIG. 7) described later. The developing roller 3 is positioned at one end portion of the casing 2. A part of a peripheral surface of the developing roller 3 is exposed to an outside of the casing 2. The developing roller 3 includes a developing roller shaft 3A and a developing roller body 3B those extending in the first direction. The developing roller body 3B is cylindrical, and is rotatable along with the rotation of the developing roller shaft 3A.

1.3 Agitator 5

The agitator 5 is configured to agitate the developing agent in the casing 2 and to convey the developing agent in the casing 2 to the developing roller 3. The agitator 5 is positioned inside the casing 2. The agitator 5 is rotatable about a third axis A3 extending in the first direction. The agitator 5 includes an agitator shaft 5A and blades 5B. The agitator shaft 5A extends along the third axis A3. Each of the blades 5B extends in a direction crossing the third axis A3.

1.4 Handle 6

The handle 6 allows a user to be gripped by when the user handles the developing cartridge 1. The handle 6 is positioned opposite to the developing roller 3 with respect to the casing 2. The handle 6 extends from the other end portion of the casing 2 in a direction away from the developing roller 3.

2 Details of Gear Train 8

Figure 2:
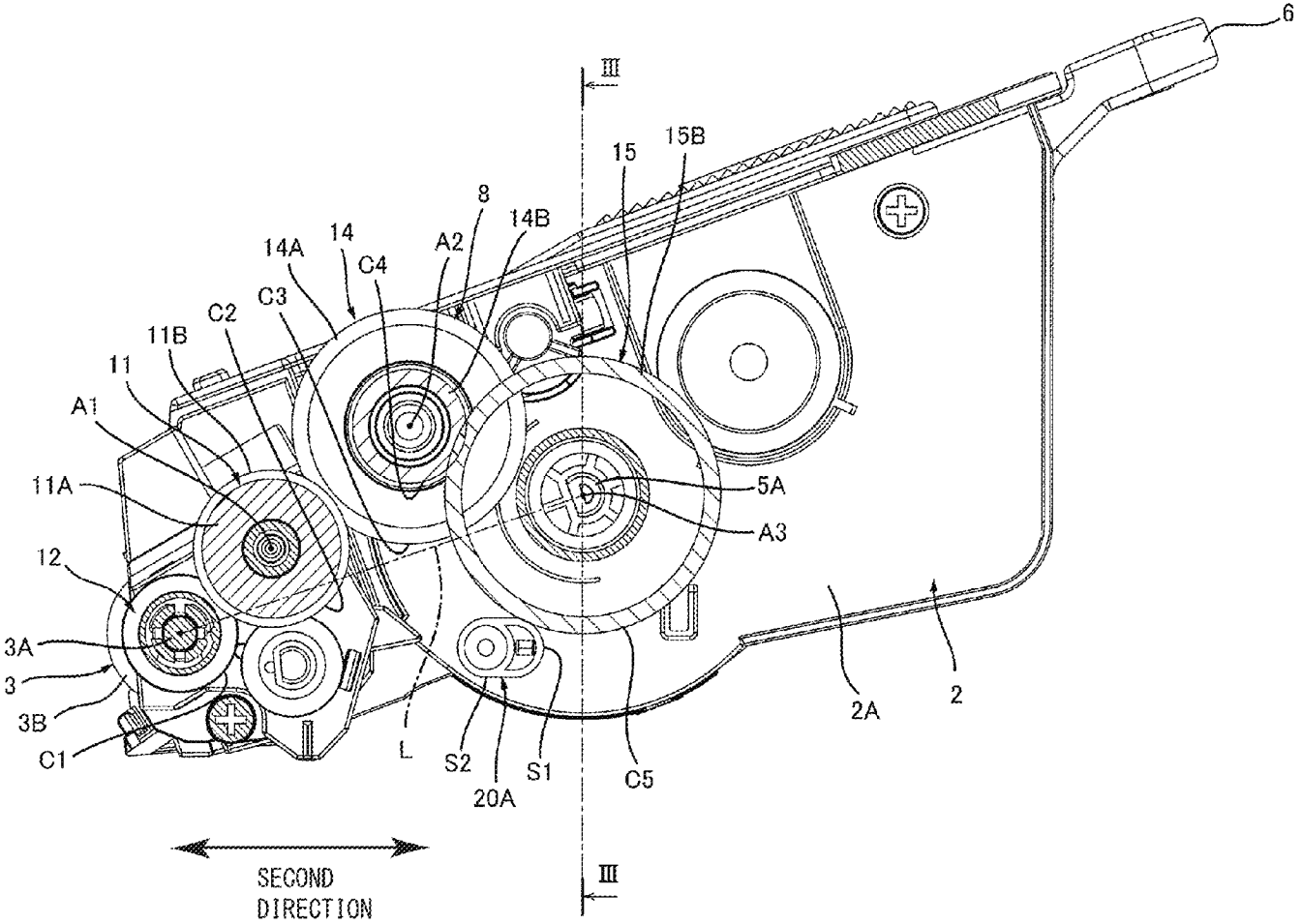
FIG. 2 is a side view of the developing cartridge.

As illustrated in FIGS. 1 and 2, the gear train 8 is configured to transmit driving force from the image forming apparatus to the developing roller 3 and the agitator 5. The gear train 8 is positioned at the outer surface 2A of the casing 2. The gear train 8 includes a coupling 11, a developing roller gear 12, an idle gear 14, and an agitator gear 15.

2.1 Coupling 11

The coupling 11 is configured to receive the driving force from the image forming apparatus. The coupling 11 is positioned at the outer surface 2A and is attached to the outer surface 2A. The coupling 11 extends in the first direction and is rotatable about a first axis A1 extending in the first direction. The coupling 11 has one end portion and another end portion in the first direction. The other end portion of the coupling 11 is farther from the casing 2 than the one end portion of the coupling 11 from the casing 2 in the first direction. The coupling 11 includes a coupling gear 11A and a joint 11B.

The coupling gear 11A is positioned at the one end portion of the coupling 11 in the first direction. The coupling gear 11A is positioned between the outer surface 2A and the joint 11B in the first direction. The coupling gear 11A includes a plurality of gear teeth positioned at a peripheral surface of the coupling gear 11A.

The joint 11B is configured to be connectable to a driving force input portion (not shown) of the image forming apparatus. Upon connection, the joint 11B is rotatable together with the rotation of the driving force input portion. The joint 11B is positioned at the other end portion of the coupling 11, and is positioned opposite to the outer surface 2A with respect to the coupling gear 11A in the first direction. The joint 11B is integral with the coupling gear 11A, so that the coupling gear 11A and the joint 11B are rotatable together.

2.2 Developing Roller Gear 12

The developing roller gear 12 is configured to transmit the driving force from the coupling 11 to the developing roller shaft 3A. The developing roller gear 12 is positioned at the outer surface 2A whose side is the same as that of the coupling 11 in the first direction. The developing roller gear 12 is in meshing engagement with the coupling gear 11A. The developing roller gear 12 is mounted to the end portion of the developing roller shaft 3A and is rotatable together with the rotation of the developing roller shaft 3A. The developing roller gear 12 is positioned at the outer surface 2A because the developing roller gear 12 is mounted to the end portion of the developing roller shaft 3A. The developing roller gear 12 includes a plurality of gear teeth positioned at a peripheral surface of the developing roller gear 12.

2.3 Idle Gear 14

The idle gear 14 is configured to transmit the driving force from the coupling 11 to the agitator gear 15. The idle gear 14 is positioned at the outer surface 2A, and is attached to the outer surface 2A. The idle gear 14 is positioned at the outer surface 2A whose side is the same as that of the coupling 11 in the first direction. The idle gear 14 is positioned spaced away from the developing roller gear 12 in a circumferential direction of the coupling gear 11A. More specifically, the idle gear 14 is positioned opposite to the developing roller gear 12 with respect to the coupling gear 11A in a diametrical direction of the coupling 11. The idle gear 14 includes a first idle gear 14A and a second idle gear 14B.

The first idle gear 14A and the second idle gear 14B are arrayed side by side in the first direction. The second idle gear 14B is positioned opposite to the outer surface 2A with respect to the first idle gear 14A in the first direction. That is, the second idle gear 14B is positioned farther from the outer surface 2A than the first idle gear 14A from the outer surface 2A in the first direction. The first idle gear 14A is in meshing engagement with the coupling gear 11A, and the second idle gear 14B is in meshing engagement with the agitator gear 15. The first idle gear 14A and the second idle gear 14B are rotatable together about a second axis A2 extending in the first direction. The first idle gear 14A includes a plurality of gear teeth positioned at a peripheral surface of the first idle gear 14A. The second idle gear 14B has a diameter smaller than that of the first idle gear 14A. The second idle gear 14B includes a plurality of gear teeth positioned at a peripheral surface of the second idle gear 14B.

2.4 Agitator Gear 15

The agitator gear 15 is configured to transmit the driving force from the second idle gear 14B to the agitator shaft 5A. The agitator gear 15 is positioned at the outer surface 2A whose side is the same as that of the coupling 11 in the first direction. The agitator gear 15 is in meshing engagement with the second idle gear 14B. The agitator gear 15 is mounted to one end portion of the agitator shaft 5A, and is rotatable together with the rotation of the agitator shaft 5A. The agitator gear 15 is positioned at the outer surface 2A because the agitator gear 15 is mounted to the end portion of the agitator shaft 5A. The agitator gear 15 has an end surface 15A (FIG. 3) in confrontation with the outer surface 2A in the first direction. The end surface 15A is spaced away from the outer surface 2A in the first direction. The agitator gear 15 includes a plurality of gear teeth positioned at a peripheral surface 15B of the agitator gear 15.

3. First and Second Protrusions 20A, 20B

Figure 3:
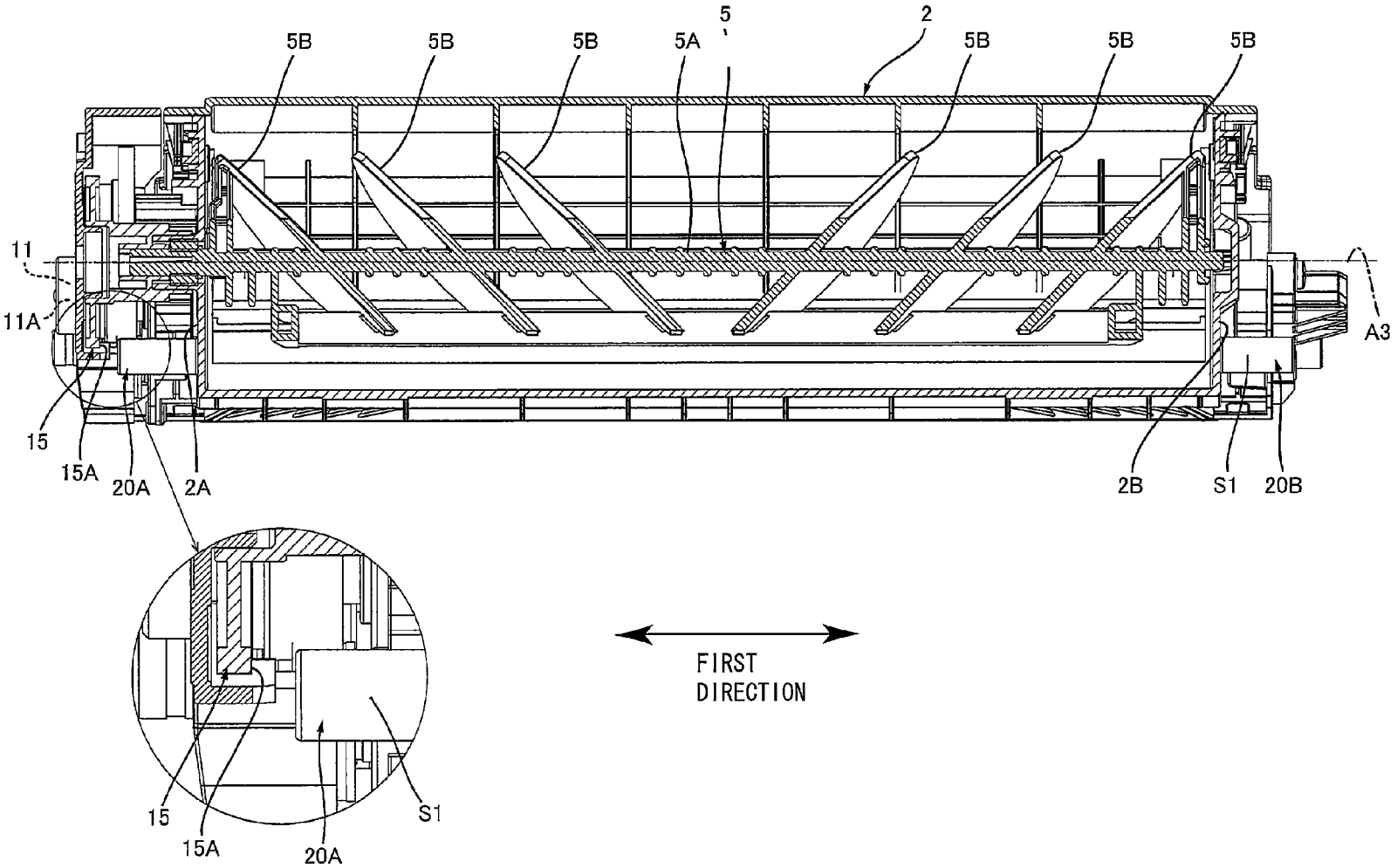
FIG. 3 is a cross-sectional view taken along a line of FIG. 2.

As illustrated in FIGS. 2 and 3, the casing 2 further includes a first protrusion 20A and a second protrusion 20B. The first protrusion 20A is positioned at the outer surface 2A, and more specifically, is attached to the outer surface 2A. The second protrusion 20B is positioned at the outer surface 2B, and more specifically, is attached to the outer surface 2B. At least a portion of the second protrusion 20B is aligned with at least a portion of the first protrusion 20A in the first direction. The second protrusion 20B has a structure the same as that of the first protrusion 20A. Therefore, in the following description the description as to the structure of the first protrusion 20A will be described and description as to the structure of the second protrusion 20B will be omitted.

3.1 Position of First Protrusion 20A

As illustrated in FIGS. 2 through 6, the first protrusion 20A extends in the first direction. The first protrusion 20A is positioned opposite to the second idle gear 14B with respect to an imaginary line L connecting a central axis of the developing roller 3 to the third axis A3. The first protrusion 20A is positioned between the first axis A1 and the third axis A3 in a direction connecting between the first axis A1 and the third axis A3. The first protrusion 20A is positioned outside of an addendum circle C1 of the developing roller gear 12 in a radial direction of the developing roller gear 12. Further, the first protrusion 20A is positioned outside of an addendum circle C2 of the coupling gear 11A in a radial direction of the coupling gear 11A. Further, the first protrusion 20A is positioned outside of an addendum circle C3 of the first idle gear 14A in a radial direction of the first idle gear 14A. Further, the first protrusion 20A is positioned outside of an addendum circle C4 of the second idle gear 14B in a radial direction of the second idle gear 14B. Further, at least a portion of the first protrusion 20A is positioned inside of an addendum circle C5 of the agitator gear 15 in a radial direction of the agitator gear 15.

The first protrusion 20A is positioned between the outer surface 2A and the end surface 15A of the agitator gear 15 in the first direction. Further, the end surface 15A is spaced away from the first protrusion 20A in the first direction. With this structure, the first protrusion 20A does not interrupt the rotation of the agitator gear 15 even if the first protrusion 20A is positioned inside of the addendum circle C5 of the agitator gear 15. As a result, the coupling 11, the idle gear 14, and the agitator gear 15 can be rotated in spite of the fact that the first protrusion 20A is positioned close to the developing roller 3.

3.2 Structure of First Protrusion 20A

Figure 4:
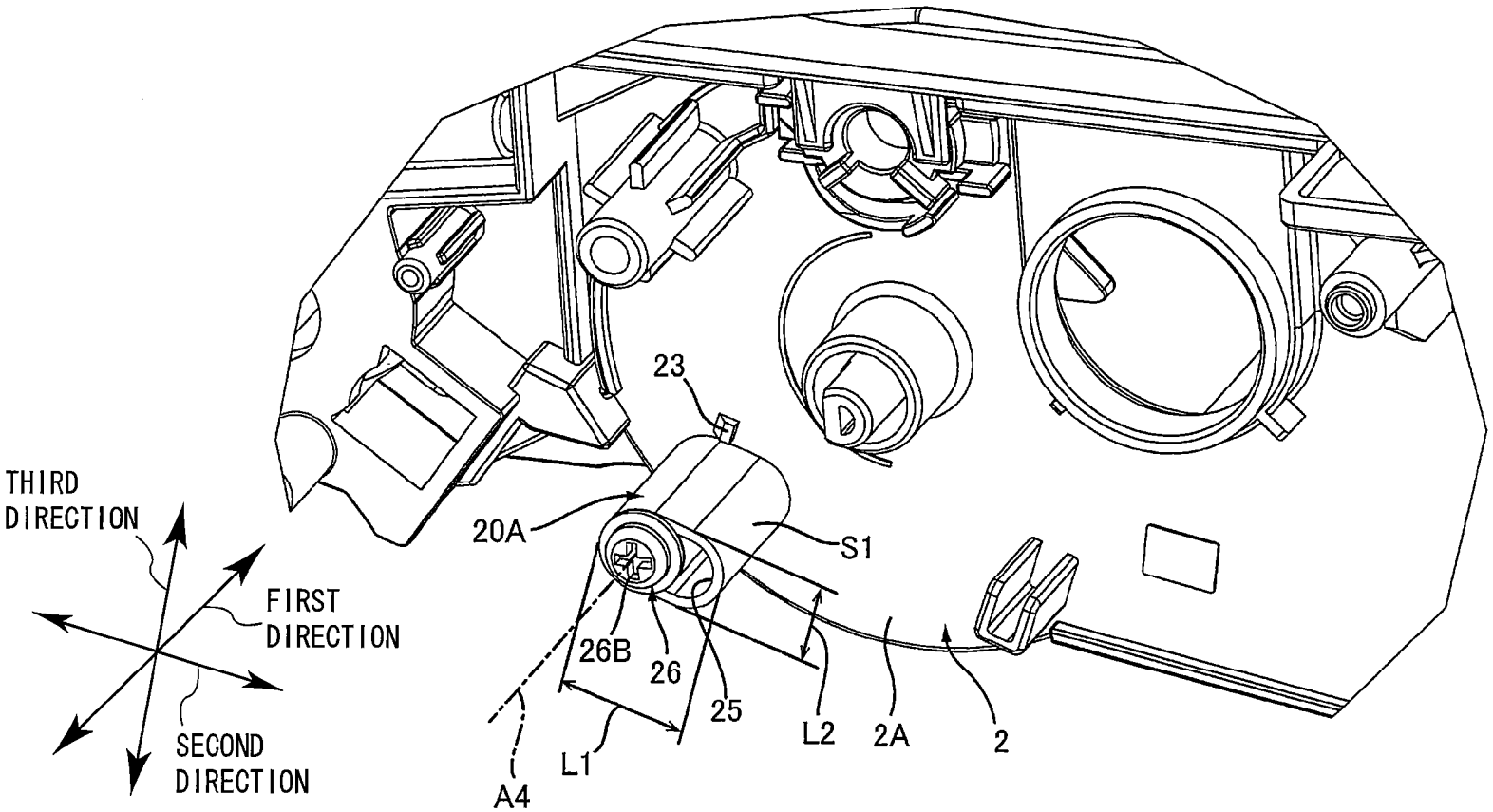
FIG. 4 is a partial perspective view of the developing cartridge particularly illustrating a protrusion positioned at its first position.
Figure 5:
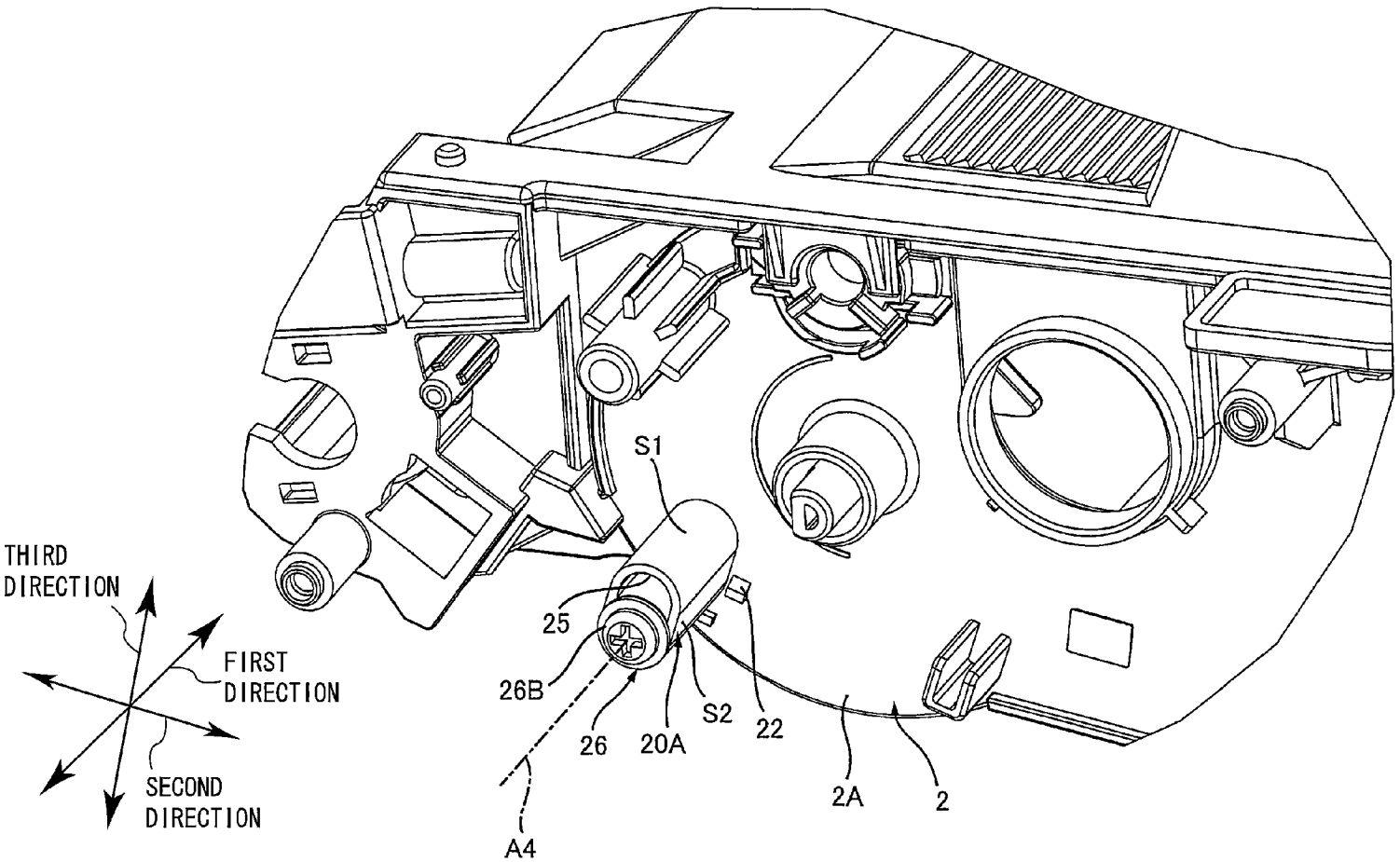
FIG. 5 is a partial perspective view of the developing cartridge particularly illustrating the protrusion positioned at its second position.

As illustrated in FIGS. 4 and 5, the first protrusion 20A is pivotally movable about a fourth axis A4 extending in the first direction. The first protrusion 20A is movable between a first position (FIG. 4) and a second position (FIG. 5) as a result of the pivotal movement thereof. In the following description, the first protrusion 20A at the first position will be first described with reference to FIGS. 2 and 4.

As illustrated in FIGS. 2 and 4, the first protrusion 20A extends in a second direction connecting between the developing roller 3 and the first protrusion 20A. The second direction crosses the first direction and the fourth axis A4. Preferably, the second direction may be a direction crossing and perpendicular to both of the developing roller shaft 3A as the rotation axis of the developing roller 3 and the fourth axis A4 as the rotation axis of the first protrusion 20A. Furthermore, the cross-section of the first protrusion 20A crossing the first direction may extend in the second direction.

The first protrusion 20A has a first length L1 in the second direction. Further, the first protrusion 20A has a second length L2 in a third direction crossing the first and second directions. Preferably, the third direction may be perpendicular to the first and second directions. The second length L2 is smaller than the first length L2. The first protrusion 20A has a one end portion and another end portion in the second direction. The other end portion of the first protrusion 20A is positioned closer to the fourth axis A4 than the one end portion of the first protrusion 20A to the fourth axis A4. The first protrusion 20A has a first surface S1 and a second surface S2. The first surface S1 is positioned at the one end portion of the first protrusion 20A in the second direction. The second surface S2 is continuous with the first surface S1 and extends in the second direction.

Figure 7:
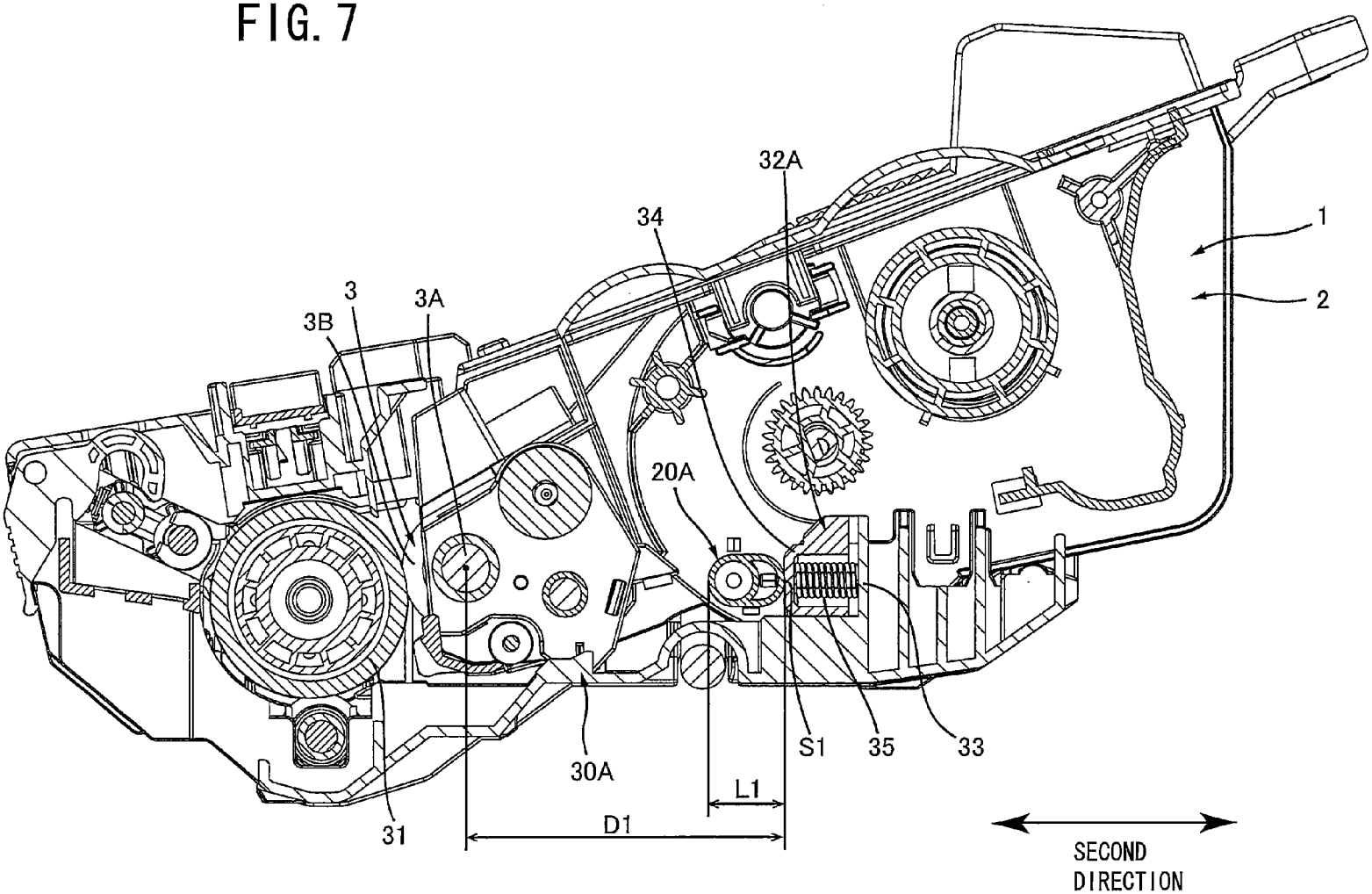
FIG. 7 is a cross-sectional view illustrating the developing cartridge and a drum cartridge of a first type, and illustrating a state where the developing cartridge is attached to the drum cartridge of the first type.
Figure 8:
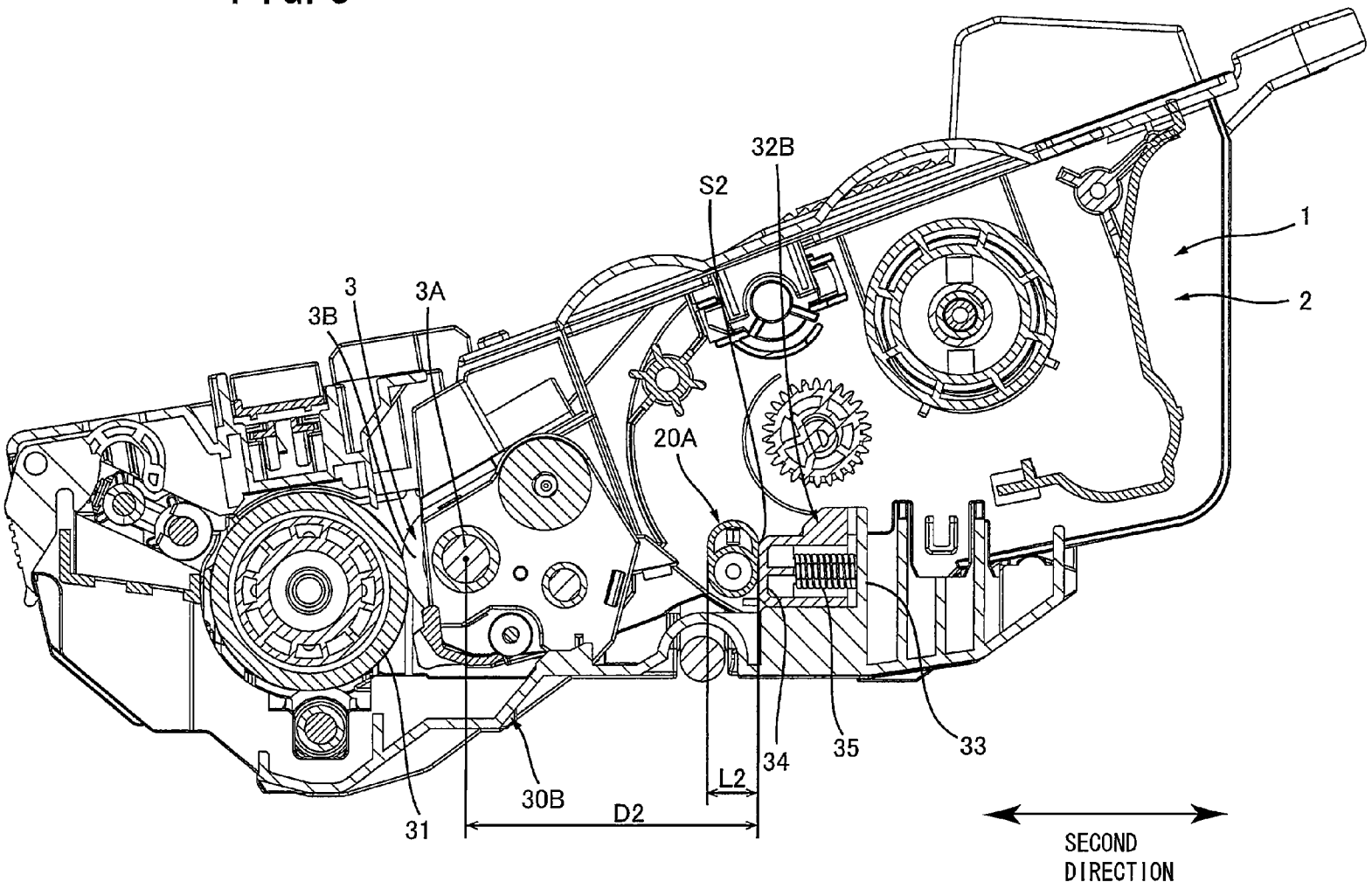
FIG. 8 is a cross-sectional view illustrating the developing cartridge and a drum cartridge of a second type, and illustrating a state where the developing cartridge is attached to the drum cartridge of the second type.

As illustrated in FIGS. 4 and 7, the first position is such a position where the length of the first protrusion 20A is L1 in the second direction and is L2 in the third direction. By contrast, as illustrated in FIGS. 5 and 8, the second position is such a position where the length of the first protrusion 20A is L2 in the second direction and is L1 in the third direction.

The first surface S1 is configured to receive pressing force directing toward the developing roller 3 from a first type of drum cartridge 30A (described later) when the first protrusion 20A is at the first position. The first surface S1 is a curved surface when the first protrusion 20A is at the first position.

The second surface S2 is configured to receive pressing force directing toward the developing roller 3 from a second type of drum cartridge 30B (described later) when the first protrusion 20A is at the second position. The second surface S2 is a flat surface. As illustrated in FIGS. 7 and 8, a distance D2 between the central axis of the developing roller shaft 3A and a distal end of the second surface S2 at the second position of the first protrusion 20A is smaller than a distance D1 between the central axis of the developing roller shaft 3A and the first surface S1 at the first position of the first protrusion 20A.

3.3 Structure for Attaching First Protrusion 20A

Figure 6:
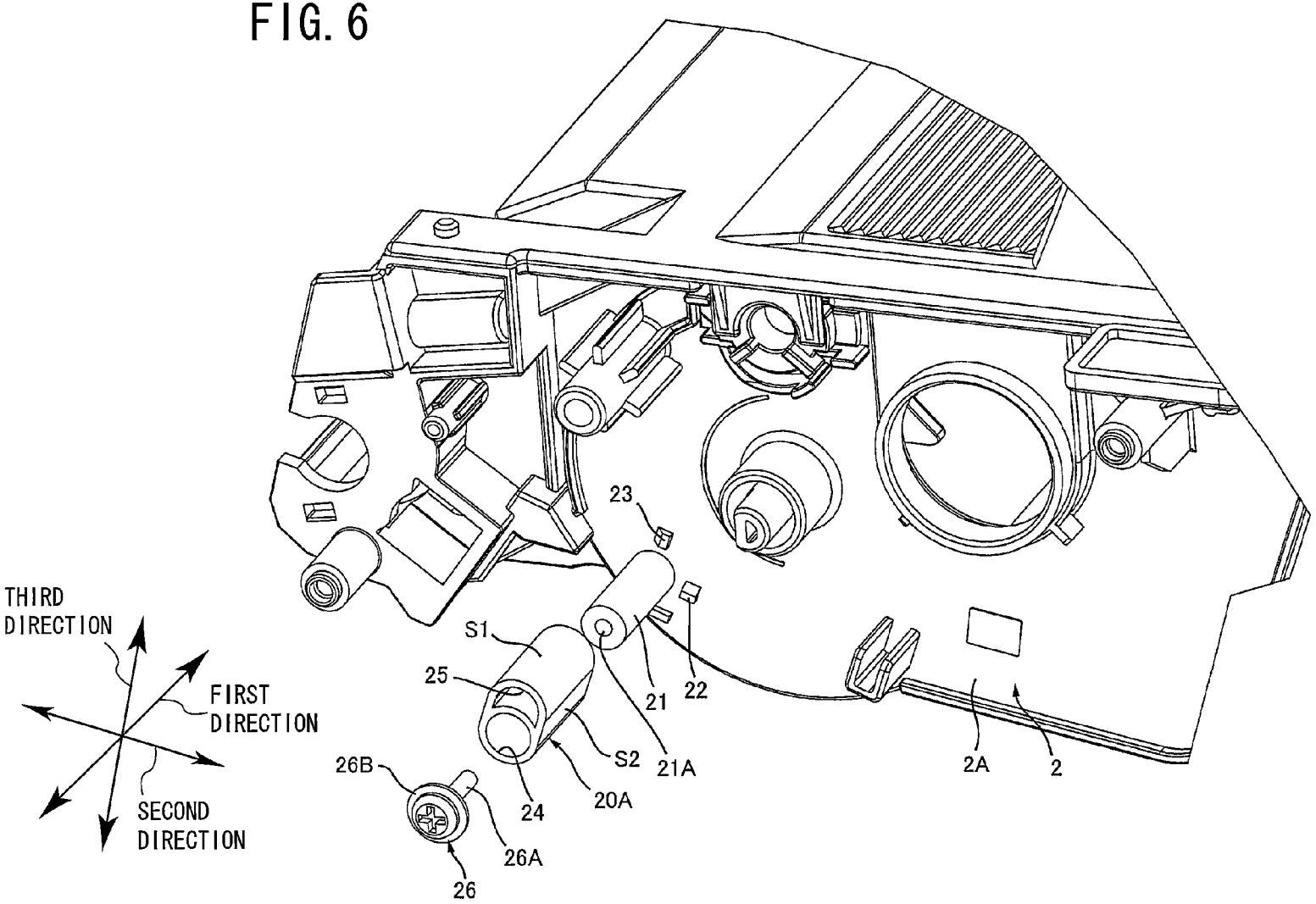
FIG. 6 is a partial perspective view of the developing cartridge, and illustrating an exploded perspective view of the protrusion.

As illustrated in FIG. 6, the first protrusion 20A is formed with a first through-hole 24 and a second through-hole 25. The first through-hole 24 is cylindrical extending through the first protrusion 20A along its length in the first direction. The second through-hole 25 extends through the first protrusion 20A along its length in the first direction.

As illustrated in FIG. 6, the casing 2 further includes a shaft 21, a first stopper 22, and a second stopper 23, those being positioned at the outer surface 2A. The shaft 21 integrally extends from the outer surface 2A along the fourth axis A4. Alternatively, the shaft 21 can be a separate member, and can be attached to the outer surface 2A. The shaft 21 is cylindrical and is inserted into the first through-hole 24. Thus, the first protrusion 20A is rotatable relative to the shaft 21. Incidentally, instead of the first through-hole 24, which is a through-hole, a hole having a depth smaller than the length of the first protrusion 20A can be formed in the first protrusion 20A as long as the shaft 21 can be inserted into the hole. The shaft 21 is formed with a shaft hole 21A.

As illustrated in FIG. 6, the first stopper 22 is positioned opposite to the developing roller 3 with respect to the shaft 21 in the second direction. The first stopper 22 is fitted with the second through-hole 25 when the first protrusion 20A is positioned at its first position preventing the first protrusion 20A from displacing from the first position. Further, the first stopper 22 integrally protrudes from the outer surface 2A in the first direction. Alternatively, the first stopper 22 can be a separate member, and can be attached to the outer surface 2A.

The second stopper 23 is positioned closer to the developing roller 3 than the first stopper 22 to the developing roller 3 in the second direction. The second stopper 23 is fitted with the second through-hole 25 when the first protrusion 20A is positioned at its second position preventing the first protrusion 20A from displacing from the second position. Incidentally, instead of the second through-hole 25, which is a through-hole, a hole having a depth smaller than the length of the first protrusion 20A can be formed in the first protrusion 20A as long as the second stopper 23 can be inserted into the hole. Further, the second stopper 23 integrally protrudes from the outer surface 2A in the first direction. Alternatively, the second stopper 23 can be a separate member, and can be attached to the outer surface 2A.

As illustrated in FIGS. 4 and 5, a male thread 26 is threadingly engaged with the shaft hole 21A so as to prevent the first protrusion 20A from releasing from the shaft 21. More specifically, as illustrated in FIG. 6, the male thread 26 includes a thread portion 26A threadingly engaged with the shaft hole 21A, and a head portion 26B provided at one end of the thread portion 26A. The head portion 26B has a diameter greater than that of the first through-hole 24. The male thread 26 is fixed to the shaft 21 while the first protrusion 20A is mounted to the shaft 21. In this case, the head portion 26B faces an open end face of the first through-hole 24 in the first direction preventing the first protrusion 20A from releasing from the shaft 21.

4. First Type of Drum Cartridge 30A

The first type of the drum cartridge 30A will be described with reference to FIG. 7. The drum cartridge 30A is configured to receive and release the developing cartridge 1, and is attachable to and detachable from the image forming apparatus. The drum cartridge 30A includes the photosensitive drum 31 positioned at one end portion of the drum cartridge 30A.

The drum cartridge 30A further includes a first pressure member 32A adapted to press the developing cartridge 1 attached to the drum cartridge 30A toward the photosensitive drum 31. More specifically, the first pressure member 32A is configured to press the first surface S1 of the first protrusion 20A, so that the first surface S1 is urged toward the photosensitive drum 31.

The first pressure member 32A is positioned spaced away from the photosensitive drum 31 in a radial direction thereof. As a result of attachment of the developing cartridge 1 to the drum cartridge 30A, a direction connecting between the first pressure member 32A and the photosensitive drum 31 is coincident with the second direction. The following description will be based on the state where the developing cartridge 1 is attached to the drum cartridge 30A. The first pressure member 32A includes a support wall 33, a pressing wall 34, and a compression spring 35.

The support wall 33 extends in a direction crossing the second direction. Preferably, the support wall 33 may extend in a direction perpendicular to the second direction.

The pressing wall 34 is positioned between the support wall 33 and the photosensitive drum 31 in the second direction. The pressing wall 34 is positioned spaced away from the support wall 33 in the second direction. The pressing wall 34 extends in a direction crossing the second direction. Preferably, the pressing wall 34 may extend in a direction perpendicular to the second direction.

The compression spring 35 is positioned between the support wall 33 and the pressing wall 34 in the second direction, and extends in the second direction. The compression spring 35 has one end portion in the second direction which is in contact with the pressing wall 34, and another end portion in the second direction which is in contact with the support wall 33.

The drum cartridge 30A also includes a second pressure member having a structure the same as that of the first pressure member 32A. The second pressure member is positioned spaced away from the first pressure member 32A in an axial direction of the photosensitive drum 31.

5. Attaching State of Developing Cartridge 1 Relative to Drum Cartridge 30A For attaching the developing cartridge 1 to the drum cartridge 30A, the first protrusion 20A is positioned at the first position. As a result of the attachment of the developing cartridge 1 to the drum cartridge 30A, the pressing wall 34 is in contact with the first surface S1 of the first protrusion 20A. In this state, the compression spring 35 positioned between the support wall 33 and the pressing wall 34 is compressed in the second direction, so that the pressing wall 34 presses the first protrusion 20A toward the photosensitive drum 31. Similarly, the second pressure member is in contact with the first surface S1 of the second protrusion 20B upon attachment of the developing cartridge 1 to the drum cartridge 30A. Thus, the second pressure member presses the second protrusion 20B toward the photosensitive drum 31.

6. Second Type of Drum Cartridge 30B

A second type of the drum cartridge 30B is illustrated in FIG. 8, wherein line parts and components are designated by the same reference numerals as those shown in FIG. 7.

The drum cartridge 30B includes a first pressure member 32B configured to press the developing cartridge 1 attached to the drum cartridge 30B toward the photosensitive drum 31, similarly to the first pressure member 32A in the first type of the drum cartridge 30A. More specifically, the first pressure member 32B is configured to press the second surface S2 of the first protrusion 20A, so that the second surface S2 is urged toward the photosensitive drum 31. The first pressure member 32B includes the support wall 33, pressing wall 34, and compression spring 35.

The pressing wall 34 of the drum cartridge 30B is positioned closer to the photosensitive drum 31 than the pressing wall 34 of the drum cartridge 30A to the photosensitive drum 31 in the second direction.

7. Attaching State of Developing Cartridge 1 Relative to Drum Cartridge 30B For attaching the developing cartridge 1 to the drum cartridge 30B, the first protrusion 20A is positioned at the second position. As a result of the attachment of the developing cartridge 1 to the drum cartridge 30B, the pressing wall 34 is in contact with the second surface S2 of the first protrusion 20A. In this state, the pressing wall 34 presses the first protrusion 20A of the developing cartridge 1 toward the photosensitive drum 31. Similarly. the second pressure member is in contact with the second surface S2 of the second protrusion 20B upon attachment of the developing cartridge 1 to the drum cartridge 30B. Thus, the second pressure member presses the second protrusion 20B toward the photosensitive drum 31.

8. Function and Effect

According to the developing cartridge 1, the first protrusion 20A has the first length L1 in the second direction when the first protrusion 20A is positioned at the first position as illustrated in FIG. 4. Further, the first protrusion 20A has the second length L2 smaller than the first length L1 in the second direction when the first protrusion 20A is positioned at the second position as illustrated in FIG. 5.

With this arrangement, the distance D1 between the developing roller 3 and the first surface S1 when the first protrusion 20A is positioned at the first position is different from the distance D2 between the developing roller 3 and the second surface S2 when the first protrusion 20A is positioned at the second position. More specifically, the distance D1 is greater than the distance D2.

Accordingly, the distance between the pressure receiving surface and the developing roller 3 in the second direction can be adjusted in accordance with the distance between the photosensitive drum 31 and the pressing wall 34 by the pivotal movement of the first protrusion 20A in such a situation where the distance between the photosensitive drum 31 and the pressing wall 34 in the drum cartridge 30A is different from that in the drum cartridge 30B.

More specifically, the first protrusion 20A is set to the first position for attaching the developing cartridge 1 to the drum cartridge 30A. Consequently, the distance D1 between the developing roller 3 and the first surface S1 conforms the distance between the photosensitive drum 31 and the pressing wall 34. Further, the first protrusion 20A is set to the second position for attaching the developing cartridge 1 to the drum cartridge 30B. Consequently, the distance D2 between the developing roller 3 and the second surface S2 conforms the distance between the photosensitive drum 31 and the pressing wall 34.

In this way, the developing cartridge 1 can be attached to the selected one of the drum cartridge 30A and the drum cartridge 30B by changing the position of the pressure receiving surface S1, S2 as a result of movement of the first protrusion 20A.

Further, each position of each of the pressure receiving surfaces S1, S2 can be adjusted to each position of each of the pressure members of each of the drum cartridge 30A and the drum cartridge 30B by changing the positions of the pressure receiving surfaces S1, S2 upon pivotal movement of the first protrusion 20A.

Accordingly, appropriate pressing force can be applied to the photosensitive drum 31 not only when the developing cartridge 1 is attached to the drum cartridge 30A but also when the developing cartridge 1 is attached to the drum cartridge 30B.

9. Modifications

According to the above-described embodiment, the developing cartridge 1 is attached to the drum cartridge 30B while the first protrusion 20A is positioned at the second position. However, the developing cartridge 1 can be attached to the drum cartridge 30B while the first protrusion 20A is positioned at the first position.

In the latter case, the first protrusion 20A is positioned at the first position prior to the attachment of the developing cartridge 1 to the drum cartridge 30B. During attachment of the developing cartridge 1 to the drum cartridge 30B, the first protrusion 20A is pivotally moved from the first position to the second position by the abutment of the first protrusion 20A against the pressing wall 34.

More specifically, when the developing cartridge 1 is pushed into the drum cartridge 30B by a user, the first protrusion 20A moves past the first stopper 22 upon receipt of reaction force from the pressing wall 34. Thus, the first stopper 22 is released from the second through-hole 25 of the first protrusion 20A, which permits first protrusion 20A to be pivotally movable from the first position to the second position. By further pushing the developing cartridge 1 into the drum cartridge 30B by the user, the first protrusion 20A moves past the second stopper 23 to be positioned at the second position. As a result, the second stopper 23 is positioned in and fitted with the second through-hole 25 of the first protrusion 20A, whereupon the second stopper 23 prevents the first protrusion 20A from moving from the second position.

Then, the attachment of the developing cartridge 1 to the drum cartridge 30B is completed while the first protrusion 20A is positioned at the second position.

Further, the pressing wall 34 can be omitted in the first pressure member 32A and the first pressure member 32B. In this case, the first protrusion 20A is pressed directly by the compression spring 35 of the first pressure member 32A, and the second protrusion 20B is pressed directly by the compression spring 35 of the second pressure member 32B.

While the description has been made in detail with reference to specific embodiment thereof, it would be apparent to those skilled in the art that various changes and modifications may be made therein without departing from the spirit and scope of the above described embodiment.

What is claimed is:

1. A developing cartridge comprising:

a casing having an outer surface and configured to accommodate therein developing agent;

a developing roller extending in a first direction;

a developing roller gear positioned at the outer surface, mounted to the developing roller and rotatable along with the developing roller;

a coupling positioned at the outer surface and rotatable about a first axis extending in the first direction, the coupling including a coupling gear engaged with the developing roller gear and rotatable about the first axis;

a first idle gear positioned at the outer surface and rotatable about a second axis extending in the first direction, the first idle gear being engaged with the coupling gear;

a second idle gear positioned at the outer surface at a position farther from the outer surface than the first idle gear from the outer surface, the second idle gear being rotatable about the second axis along with the first idle gear and the second idle gear having a diameter smaller than a diameter of the first idle gear;

an agitator extending in the first direction and rotatable about a third axis extending in the first direction;

an agitator gear positioned at the outer surface and mounted to the agitator, the agitator gear being engaged with the second idle gear and being rotatable about the third axis along with the agitator, the agitator gear having an end face in the first direction facing the outer surface; and a first protrusion positioned between the end face and the outer surface, the first protrusion being at a position outside of a first addendum circle defined by the developing roller gear, a second addendum circle defined by the coupling gear, a third addendum circle defined by the first idle gear and a fourth addendum circle defined by the second idle gear, the first protrusion being pivotally movable about a fourth axis extending in the first direction between a first position and a second position, the first protrusion having a first length in a second direction connecting the developing roller and the first protrusion in a state where the first protrusion is at the first position, the first protrusion having a second length in the second direction in a state where the first protrusion is at the second position, the second length being different from the first length.

2. The developing cartridge according to claim 1, wherein the second length is shorter than the first length.

3. The developing cartridge according to claim 1, wherein the first protrusion is attached to the outer surface.

4. The developing cartridge according to claim 1, wherein the casing has another outer surface positioned away from the outer surface in the first direction;

wherein the developing cartridge further comprises a second protrusion positioned at the another outer surface and extending in the first direction, at least a portion of the first protrusion and at least a portion of the second protrusion being aligned in the first direction.

5. The developing cartridge according to claim 4, wherein the second protrusion is attached to the another outer surface.

6. The developing cartridge according to claim 1, wherein the first protrusion is configured to receive a pressing force from a pressure member of a drum cartridge when the developing cartridge is attached to the drum cartridge, the first protrusion being at the first position prior to attachment of the developing cartridge to the drum cartridge.

7. The developing cartridge according to claim 6, wherein the first protrusion is configured to move from the first position to the second position in accordance with the attachment of the developing cartridge to the drum cartridge.

8. A developing cartridge comprising:

a casing having an outer surface and configured to accommodate therein developing agent;

a developing roller extending in a first direction;

a developing roller gear positioned at the outer surface, mounted to the developing roller and rotatable along with the developing roller;

a coupling positioned at the outer surface and rotatable about a first axis extending in the first direction, the coupling including a coupling gear engaged with the developing roller gear and rotatable about the first axis;

a first idle gear positioned at the outer surface and rotatable about a second axis extending in the first direction, the first idle gear being engaged with the coupling gear;

a second idle gear positioned at the outer surface at a position farther from the outer surface than the first idle gear from the outer surface, the second idle gear being rotatable about the second axis along with the first idle gear and the second idle gear having a diameter smaller than a diameter of the first idle gear;

an agitator extending in the first direction and rotatable about a third axis extending in the first direction;

an agitator gear positioned at the outer surface and mounted to the agitator, the agitator gear being engaged with the second idle gear and being rotatable about the third axis along with the agitator, the agitator gear having an end face in the first direction facing the outer surface; and a first protrusion positioned between the end face and the outer surface, the first protrusion being at a position outside of a first addendum circle defined by the developing roller gear, a second addendum circle defined by the coupling gear, a third addendum circle defined by the first idle gear and a fourth addendum circle defined by the second idle gear, the first protrusion being pivotally movable about a fourth axis extending in the first direction between a first position and a second position, the first protrusion having a first surface and a second surface, the first surface being configured to receive a pressing force in a first state where the first protrusion is at the first position, the second surface being configured to receive a pressing force in a second state where the first protrusion is at the second position, a first distance between the developing roller and the first surface in the first state being different from a second distance between the developing roller and the second surface in the second state.

9. The developing cartridge according to claim 8, wherein the first distance is greater than the second distance.

* * * * *